US008660466B2

(12) United States Patent
Mihara et al.

(10) Patent No.: US 8,660,466 B2
(45) Date of Patent: Feb. 25, 2014

(54) DEVELOPMENT DEVICE AND IMAGE FORMING APPARATUS INCLUDING THE SAME

(75) Inventors: Koichi Mihara, Osaka (JP); Takafumi Nagai, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 215 days.

(21) Appl. No.: 13/159,737

(22) Filed: Jun. 14, 2011

(65) Prior Publication Data

US 2011/0305484 A1 Dec. 15, 2011

(30) Foreign Application Priority Data

Jun. 14, 2010 (JP) ..... 2010-135146

(51) Int. Cl.
*G03G 15/08* (2006.01)

(52) U.S. Cl.
USPC ..... 399/254

(58) Field of Classification Search
USPC ..... 399/254, 255
See application file for complete search history.

(56) References Cited

U.S. PATENT DOCUMENTS

2004/0179865 A1* 9/2004 Nishiyama ..... 399/254

FOREIGN PATENT DOCUMENTS

| | | |
|---|---|---|
| JP | 4-240677 | 8/1992 |
| JP | 5-197283 | 8/1993 |
| JP | 2001-255723 | 9/2001 |
| JP | 2007-171865 | 7/2007 |
| JP | 2009-92869 | 5/2009 |

OTHER PUBLICATIONS

Translation of Tomoaki (JP, 05-197283, A, listed in IDS, pub date: Jun. 8, 1993).*

* cited by examiner

*Primary Examiner* — Walter L Lindsay, Jr.
*Assistant Examiner* — Frederick Wenderoth
(74) *Attorney, Agent, or Firm* — Nixon & Vanderhye, P.C.

(57) ABSTRACT

A development device comprising a developer conveying member and a developer raking member that are rotatably disposed in the developer conveyance path to conveying and agitating the developer in the developer conveyance paths, wherein the developer conveyance path includes first and second developer conveyance paths and first and second communication paths that communicating the first and second developer conveyance paths on both sides, the developer conveying member includes first and second developer conveying members that are disposed in the first and second developer conveyance paths, the developer raking member is disposed in at least one of the first and second communication paths.

7 Claims, 10 Drawing Sheets

DEVELOPMENT DEVICE AND IMAGE FORMING APPARATUS INCLUDING THE SAME

CROSS-REFERENCE TO RELATED APPLICATION

This application is related to Japanese patent application No. 2010-135146 filed on Jun. 14, 2010 whose priority is claimed under 35 USC §119, the disclosure of which is incorporated by reference in its entirety.

BACKGROUND OF THE INVENTION

1. Field of the Invention

The present invention relates to a development device in which a two-component developer is used and an image forming apparatus including the same.

2. Description of the Related Art

Recently a two-component developer (hereinafter simply referred to as "developer") having excellent toner charging stability is widely used in an electrophotographic image forming apparatus that meets a full-color image and a high-quality image. The developer includes a toner and a carrier. When the developer is agitated in a developer tank of a development device, a properly-charged toner is obtained by friction between the toner and the carrier. In the development device, the charged toner is supplied to a surface of a development roller, and the charged toner is moved to an electrostatic latent image formed on a photoconductive drum from the development roller by an electrostatic suction power. Therefore, a toner image is formed on the photoconductive drum based on the electrostatic latent image.

Additionally, there is a demand for a high-speed, miniaturized image forming apparatus. Therefore, it is necessary to quickly and sufficiently charge the developer, and also to quickly transfer the developer. For example, Japanese Patent Application Laid-Open No. 2001-255723 proposes a cycling type development device including first and second developer conveyance paths that are divided by a partition plate provided in the developer tank, first and second communication paths that communicate the first developer conveyance path and the second developer conveyance path on both end sides, and first and second auger screws that are disposed in the first and second developer conveyance paths to mutually convey the developer in opposite directions.

Because the development device of Japanese Patent Application Laid-Open No. 2001-255723 does not include a driving section that conveys the developer in the first and second communication paths, a flow of the developer tends to be disrupted in the first and second communication paths. On the other hand, Japanese Patent Application Laid-Open No. 4-240677 proposes a development device in which third and fourth auger screws are provided in a direction orthogonal to the first and second auger screws in the first and second communication paths.

However, there is a problem in the development device of Japanese Patent Application Laid-Open No. 4-240677. The first auger screw is disposed from an upstream end to a downstream end in the first developer conveyance path, and the second auger screw is disposed from the upstream end to the downstream end in the second developer conveyance paths. Therefore, the third and fourth auger screws in the communication paths and the first and second auger screws are designed so as not to come into contact with each other. That is, in an intersection part in which each developer conveyance path and each communication path intersect at right angle, a rotating shaft of the first and second auger screws differs from a rotating shaft of the third and fourth auger screws in a height, and a spiral blade of each auger screw is eliminated. Therefore, in the development device of Japanese Patent Application Laid-Open No. 4-240677, the developer is easily retained in four corners at the upstream end and the downstream end of the first and second developer conveyance paths.

A compressive force is applied to the developer retained in the four corners of the developer tank by a developer conveyed by each auger screw. When such stress as the compressive force continues over a long period, a fluidity improver that is of a toner additive is buried in resin particles constituting the toner, which results in a phenomenon in which developer fluidity is extremely degraded to hardly convey the developer. As a result, a sufficient amount of the developer is hardly supplied to the photoconductive drum through the development roller, which results in a problem in that density of the image printed on a recording medium is reduced.

SUMMARY OF THE INVENTION

An object of the present invention is to provide a development device that can reduce the stress applied to the developer to prevent the image density reduction by suppressing a rapid pressure increase of the developer during cycling conveyance, and an image forming apparatus including the same.

According to an aspect of the present invention, a development device that is mounted on an electrophotographic image forming apparatus including a photoconductive drum of which an electrostatic to latent image is formed on a surface, the development device comprising:

a developer tank in which a developer containing a toner and a carrier are stored;

a toner replenishment port through which the toner is replenished into the developer tank;

a development roller that rotates to supply the toner to the surface of the photoconductive drum on which the electrostatic latent image is formed while bearing the developer of the developer tank;

a developer conveyance path that includes first and second developer conveyance paths and first and second communication paths, the first developer conveyance path being disposed on a side of the toner replenishment port, the second developer conveyance path being disposed on a side of the development roller, the first and second developer conveyance paths being partitioned by a partition plate parallel to a shaft direction of the development roller, the first and second communication paths communicating the first and second developer conveyance paths on both sides in the shaft center direction;

first and second developer conveying members that are disposed in the first and second developer conveyance paths; and a developer raking member that is rotatably disposed in at least one of the first and second communication paths, wherein the first and second developer conveying members includes: a rotating shaft; a spiral blade that is mounted in an outer circumferential surface of the rotating shaft; and a circumferential rotation blade that is mounted on one end on a downstream side in a developer conveyance direction of the rotating shaft, the spiral blades of the first and second developer conveying members rotate to mutually convey the developer in opposite directions, the developer is agitated about a shaft center on the conveyance direction downstream side by the circumferential rotation blades of the first and second developer conveying members, and the developer raking member rotates to convey the developer in one of the developer conveyance paths to the other of the developer conveyance path while being not in contact with the circumferential rotation blade, thereby cycling the developer between the first developer conveyance path and the second developer conveyance path.

According to another aspect of the present invention, an image forming apparatus includes: a photoconductive drum that forms an electrostatic latent image on a surface thereof; a charging device that charges the surface of the photoconductive drum; an exposure device that forms an electrostatic latent image on the surface of the photoconductive drum; the development device that supplies the toner to the electrostatic latent image on the surface of the photoconductive drum to form an toner image; a toner replenishment device that replenish the toner to the development device; a transfer device that transfers the toner image on the surface of the photoconductive drum to a recording medium; and a fixing device that fixes the toner image onto the recording medium.

According to the development device of the present invention, for example, when the developer raking member is provided in the first communication path, the developer conveyed onto the downstream side of the first developer conveyance path is raked and delivered to the second developer conveyance path by the developer raking member, which allows the retention of the developer in a downstream end part of the first developer conveyance path. Therefore, the pressure applied to the developer conveyed to the lowermost downstream side of the first developer conveyance path can be relaxed to reduce the stress. The pressure applied to the developer is generated by pressing the developer against a downstream inside wall surface of the developer tank. The same holds true for the case in which the developer raking member is provided in the second communication path.

Additionally, because a circumferential rotation blade is provided on the conveyance direction downstream side of the first and second developer conveying members, a circumferential conveyance power (agitation power in rotation direction) by the circumferential rotation blade is transmitted to the developer conveyed onto the conveyance direction downstream side by the spiral blades in the first and second developer conveyance paths. Therefore, the developer is hardly pressed against the downstream inside wall surfaces of the first and second developer conveyance paths, and the developer is hardly retained in the corners of the downstream end parts of the first and second developer conveyance paths. As a result, on the downstream sides of the first and second developer conveyance paths, the developer can smoothly be moved onto the sides of the first and second communication paths without retaining the developer while the degradation of the developer fluidity is reduced.

DETAILED DESCRIPTION OF THE PREFERRED EMBODIMENTS

Figure 1:
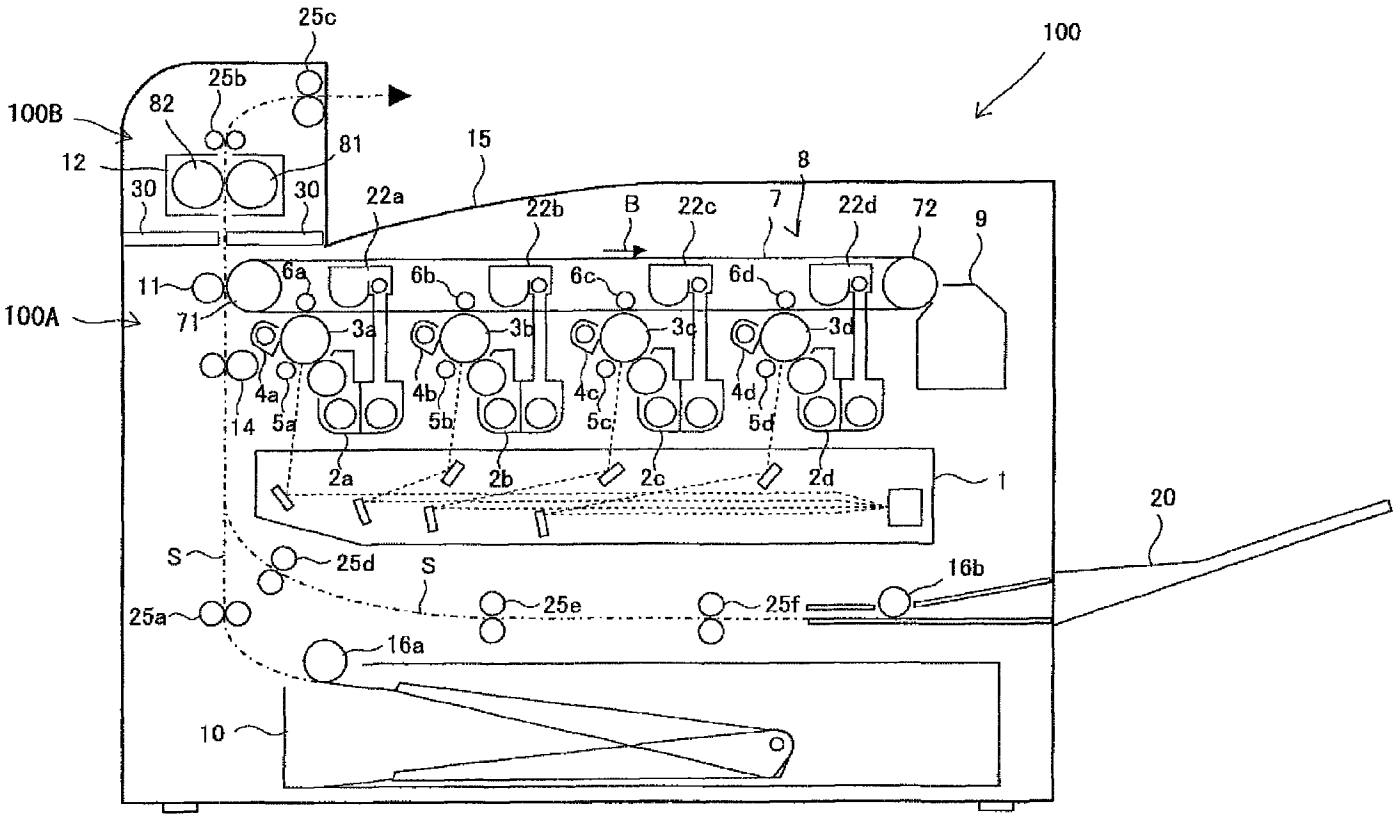
FIG. 1 illustrates an entire configuration of an image forming apparatus including a development device according to a first embodiment of the present invention.

A development device according to the present invention is a cycling type development device including a developer tank, a toner replenishment port, a development roller, first and second developer conveyance paths, first and second developer conveying members, and a developer raking member that is rotatably disposed in at least one of first and second communication paths, and the development device is mounted on an electrophotographic image forming apparatus such as a monochrome or full-color copying machine, a printer, a facsimile machine, and a complex machine having their functions.

In the development device, each of the first and second developer conveying members includes a rotating shaft, a spiral blade that is amounted in an outer circumferential surface of the rotating shaft, and a circumferential rotation blade that is mounted on one end on a downstream side in a conveyance direction of a developer in the rotating shaft. Preferably the developer raking members are provided in both the first and second communication paths in terms of the fact that the developer can smoothly be moved from one of the developer conveyance paths to the other developer conveyance path without retaining the developer while degradation of developer fluidity is reduced. Hereinafter, the "developer conveying member" means one of or both the first and second developer conveying members, the "developer conveyance path" means one of or both the first and second developer conveyance paths, and the "communication path" means one of or both the first and second communication paths.

The development device of the present invention may be configured as follows, or the configurations may be combined.

(1) The developer raking member includes a short shaft that is rotatably provided in parallel with the rotating shaft and a raking blade having plural projection pieces. The projection pieces are radially provided on an identical circumference of the short shaft at equal center angles. Therefore, a flow of the developer from a downstream end of one of the developer conveyance paths toward the communication path becomes even, and a flow of the developer passing through the communication path toward the other developer conveyance path becomes even.

(2) In the case of (1), the circumferential rotation blade includes an agitating blade having plural projection pieces. The projection pieces are radially provided on an identical circumference of the rotating shaft at equal center angles. Therefore, the flow of the developer passing through the communication path toward the other developer conveyance path becomes further even. When the projection pieces of the raking blade and the agitating blade enter rotation areas of the agitating blade and the raking blade, shapes, dispositions, projection sizes, center angles, and rotating speed of the projection pieces are adjusted such that the projection pieces do not collide with each other.

(3) In the case of (2), plural sets of the raking blade are disposed at predetermined intervals along the short shaft, plural sets of the agitating blade are disposed at predetermined intervals along the rotating shaft, and the plural sets of the raking blade and the plural sets of the agitating blade are located so as to be alternately arrayed in a shaft direction. That is, the developer raking member and the developer conveying member are disposed such that the rotation area of the raking blade and the rotation area of agitating blade overlap each other when viewed from the shaft direction, and the one set of agitating members rotates between the projection pieces of the two sets of raking blade adjacent to each other. Even if the projection pieces of the raking blade and the agitating blade enter the rotation areas of the agitating blade and the raking blade when viewed from the shaft direction, the projection pieces do not collide with each other.

Therefore, the developer scooped up by the agitating blade can smoothly be transferred to the raking blade, and the developer can efficiently be conveyed from one of the developer conveyance paths to the other developer conveyance path through the communication path. A spacing between the short shaft of the developer raking member and the rotating shaft of the developer conveying member can be decreased, and the communication path in which the developer raking member is disposed can be shortened. As a result, the compact developer tank can be implemented.

(4) In the case of (3), a ratio W/G of a width W in the shaft direction of the projection piece of the agitating blade to a distance G between the two sets of raking blade adjacent to each other ranges from 0.8 to 0.9. When the ratio W/G is lower than 0.8, a clearance between the projection pieces of the two sets of the raking blade adjacent to each other and the projection piece of the one set of agitating blade rotating between the projection pieces of the two sets of raking blade are increased to degrade transfer efficiency of the developer. When the ratio W/G is more than 0.9, the clearance is decreased to increase a shearing force (stress) applied on the developer. Therefore, when the ratio W/G is set to the range of 0.8 to 0.9, a compatibility can be achieved between improvement of the transfer efficiency of the developer and suppression of the shearing force (stress) applied on the developer.

(5) In the case of (3), a ratio M/D of a minimum clearance size M between the raking blade and the rotating shaft to a inter-shaft distance D between the short shaft of the developer raking member and the rotating shaft of the developer conveying member ranges from 0.5 to 0.95. When the ratio M/D is lower than 0.5, the minimum clearance between the raking blade and the rotating shaft is increased to degrade the transfer efficiency of the developer. When the ratio M/D is more than 0.95, the clearance is decreased to increase the shearing force (stress) applied on the developer. Therefore, when the ratio M/D is set to the range of 0.5 to 0.95, the compatibility can be achieved between the improvement of the transfer efficiency of the developer and the suppression of the shearing force (stress) applied on the developer. More preferably the ratio M/D ranges from 0.8 to 0.9.

(6) In the developer raking member, the short shaft is disposed higher than the rotating shaft, and the projection pieces of the raking blade rotates from above toward the agitating blade. Therefore, an amount of developer pushed back in a direction opposite a developer conveyance direction by the developer raking member can be reduced to decrease the retention of the developer in the communication path.

(7) In the case of (6), the projection pieces of the agitating blade rotates from below toward the raking blade. Therefore, the developer taken up by the agitating blade is moved in the developer conveyance direction by the raking blade, so that the retention of the developer can be reduced in an upper part of the agitating blade.

A development device and an image forming apparatus including the development device according to an embodiment of the present invention will be described below with reference to the drawings.

First Embodiment

FIG. 1 illustrates an entire configuration of the image forming apparatus including the development device according to a first embodiment of the present invention. An image forming apparatus 100 including a development device accommodation portion 100A in which plural development devices 2*a* to 2*d* are accommodated in a casing, a fixing device accommodation portion 100E in which a fixing device 12 is accommodated above the development device accommodation portion 100A in the casing, and a division wall 30 that is provided between the development device accommodation portion 100A and the fixing device accommodation portion 100B to insulate heat of the fixing device 12 such that the heat is not transferred onto a development device side. For example, the image forming apparatus 100 is a printer that can form a multi-color or monochrome image on a sheet-like recording medium (recording sheet) according to externally-transmitted image data. An upper surface of the development device accommodation portion 100A, located beside the fixing device accommodation portion 100B, constitutes a sheet discharge tray 15.

In the first embodiment, the image forming apparatus is the printer by way of example. Alternatively, the image forming apparatus may be a copying machine, a facsimile, or a complex machine having their functions, which can form the multi-color or monochrome image on the recording medium according to the externally-transmitted image data and/or image data scanned from an original by a scanner.

[Development Device Accommodation Portion]

As illustrated in FIG. 1, the development device accommodation portion 100A includes: four photoconductive drums 3*a*, 3*b*, 3*c*, and 3*d*; four chargers (charging device) 5*a*, 5*b*, 5*c*, and 5*d* at charge surfaces of the photoconductive drums 3*a* to 3*d*; an exposure unit (exposure device) 1 that forms electrostatic latent images on the surfaces of the photoconductive drums 3*a* to 3*d*; four development devices 2*a*, 2*b*, 2*c*, and 2*d* in which black, cyan, magenta, and yellow toners are individually stored, the development devices 2*a* to 2*d* developing the electrostatic latent images on the surfaces of the photoconductive drums 3*a* to 3*d* to form toner images; cleaner units 4*a*, 4*b*, 4*c*, and 4*d* that remove residual toners left on the surfaces of the photoconductive drums 3*a* to 3*d* after the development and image transfer; four toner replenishment devices 22*a*, 22*b*, 22*c*, and 22*d* that individually replenish the four color toners to the development device 2*a* to 2*d*; an intermediate transfer belt unit (transfer device) 8 that transfers the toner image on the surface of the photoconductive drums 3*a* to 3*d* to the recording medium; and an intermediate transfer belt cleaning unit 9.

The development device accommodation portion 100A also includes: a paper feeding tray 10 that is disposed in a lowermost part of the development device accommodation portion 100A, the plural recording mediums being stored in the paper feeding tray 10; a manual paper feeding tray 20 that is disposed on one side surface of the development device accommodation portion 100A, an irregular-size recording medium being set on the manual paper feeding tray 20; and a sheet conveyance path S through which the recording medium is conveyed to the intermediate transfer belt unit (transfer device) 8 from the paper feeding tray 10 or the manual paper feeding tray 20. In the members designated by the numerals "a" to "d", the numeral "a" designates the member used to form the black image, the numeral "b" designates the member used to form the cyan image, the numeral "c" designates the member used to form the magenta image, and the numeral "d" designates the member used to form the yellow image.

In the image forming apparatus 100, the black toner image, the cyan toner image, the magenta toner image, and the yellow toner image are selectively formed on the surfaces of the photoconductive drums 3*a* to 3*d* based on the image data of the black, cyan, magenta, and yellow color components, and the formed toner images are superposed on the intermediate transfer belt unit 8 to form a color image on the recording medium. Because the photoconductive drums 3*a* to 3*d* corresponding to the colors have the same configuration, the numerals 3*a* to 3*d* are unified by the numeral 3 in the description of the configurations of the photoconductive drums 3*a* to 3*d*. Similarly, the numerals 2*a* to 2*d* are unified by the numeral 2 in the development device, the numerals 5*a* to 5*d* are unified by the numeral 5 in the charger, the numerals 4*a* to 4*d* are unified by the numeral 4 in the cleaner unit, and the numerals 22*a* to 22*d* are unified by the numeral 22 in the toner replenishment device.

(Photoconductive Drum and Peripheral Members Thereof)

The photoconductive drum 3 includes a conductive base body and a photoconductive layer that is formed on a surface thereof, and the photoconductive drum 3 is a cylindrical member that forms the latent image by the charging and the exposure. The photoconductive drum 3 exhibits a conductive property by light irradiation, and an electric image called the electrostatic latent image is formed on the surface thereof. The photoconductive drum 3 is supported by a driving section (not illustrated) so as to be able to rotate about a shaft line.

For example, a contact roller type charger, a contact brush type charger, or a non-contact type charger is used as the charger 5 to evenly charge the surface of the photoconductive drum 3 at a predetermined potential.

The exposure unit 1 causes light corresponding to the image data to pass between the charger 5 and the development device 2, and irradiates the surface of the charged photoconductive drum 3 with the light to perform the exposure, thereby forming the electrostatic latent image corresponding to the image data on the surface of the photoconductive drum 3. In the first embodiment, a Laser Scanning Unit (LSU) including a laser irradiation portion and a reflecting mirror is used as the exposure unit 1 by way of example. Alternatively, an EL (Electroluminescence) or LED write head in which light emitting element are arrayed may be used as the exposure unit 1.

(Development Device)

Figure 2:
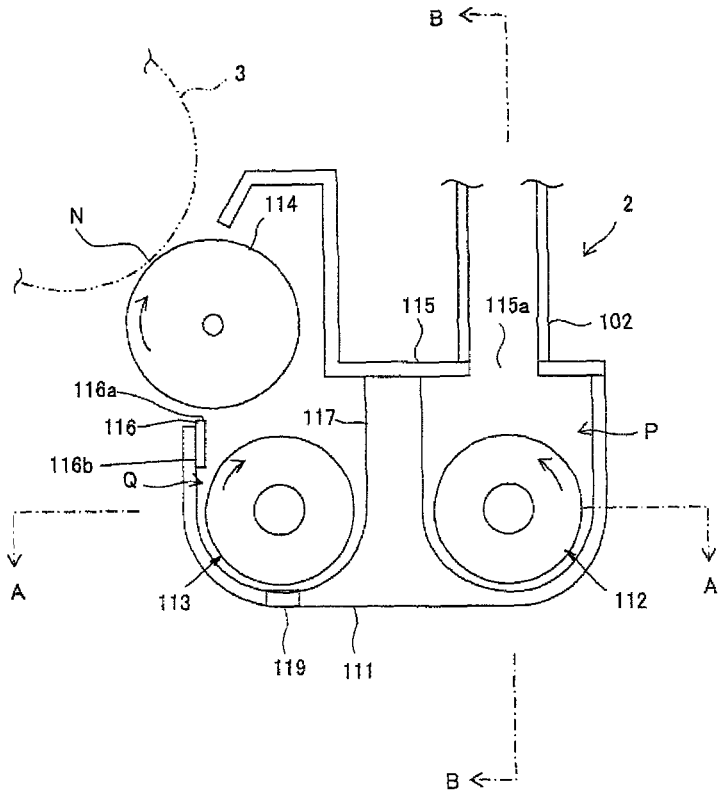
FIG. 2 is a schematic enlarged sectional view of the development device of FIG. 1.
Figure 3:
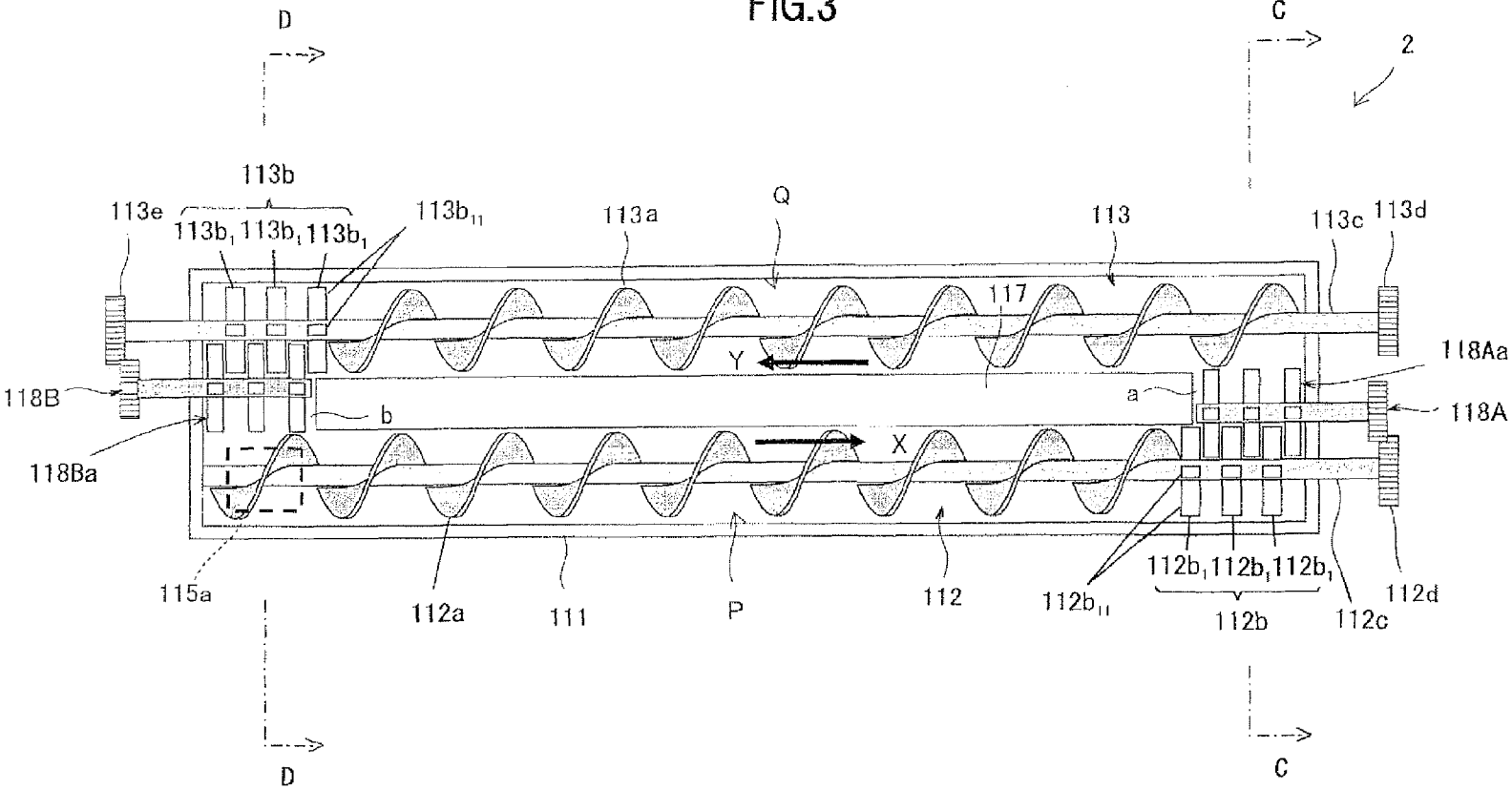
FIG. 3 is a sectional view taken on a line A-A of FIG. 2.
Figure 4:
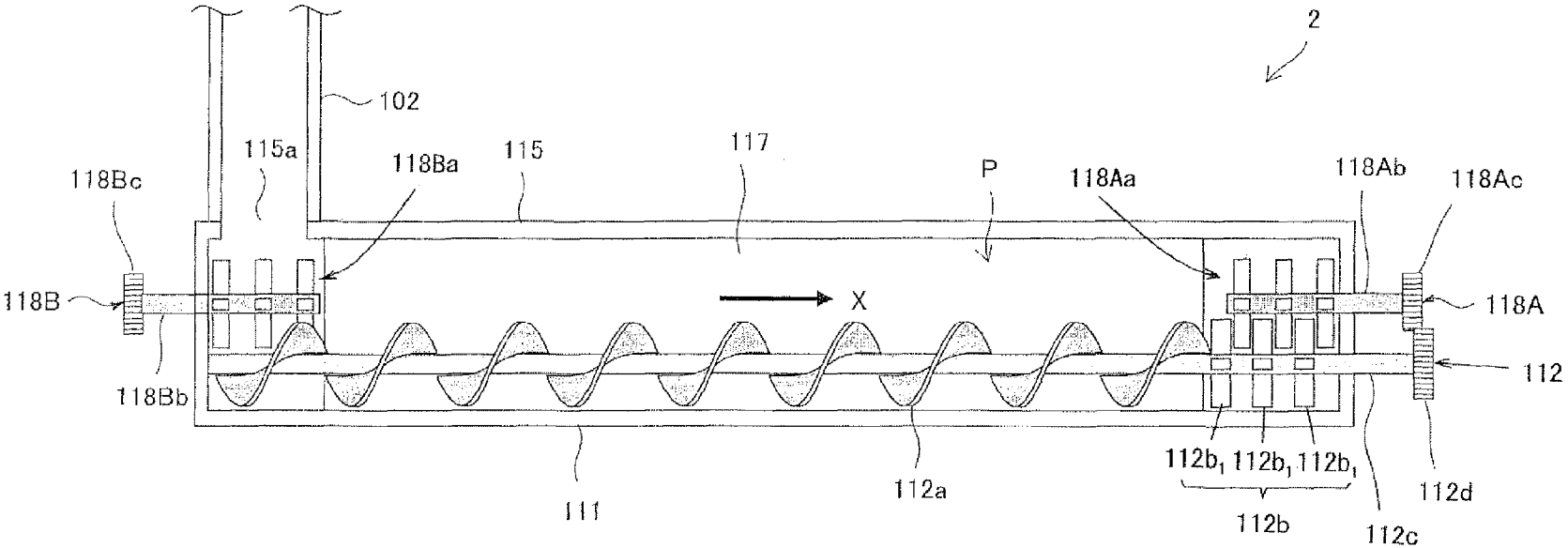
FIG. 4 is a sectional view taken on a line B-B of FIG. 2.
Figure 5:
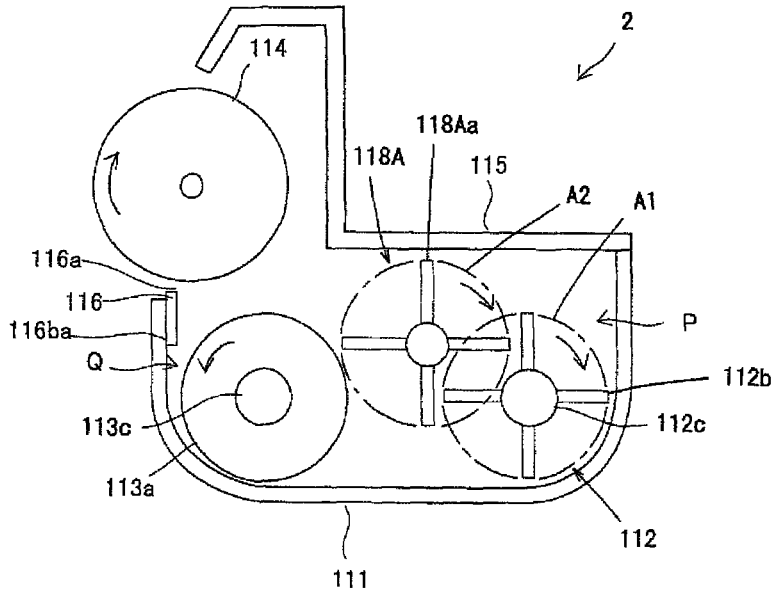
FIG. 5 is a sectional view taken on a line C-C of FIG. 3.
Figure 6:
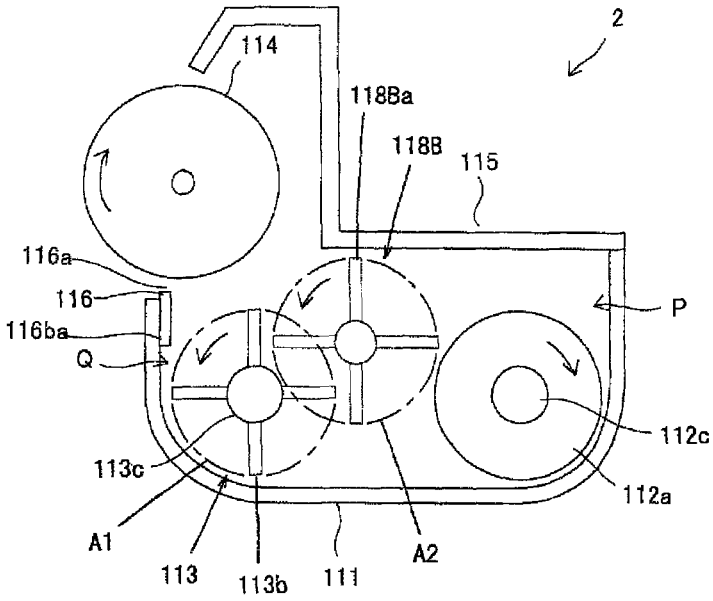
FIG. 6 is a sectional view taken on a line D-D of FIG. 3.

FIG. 2 is a schematic enlarged sectional view of the development device of FIG. 1, FIG. 3 is a sectional view taken on a line A-A of FIG. 2, FIG. 4 is a sectional view taken on a line B-B of FIG. 2, FIG. 5 is a sectional view taken on a line C-C of FIG. 3, and FIG. 6 is a sectional view taken on a line D-D of FIG. 3. In FIGS. 2 to 6, a developer stored in a developer tank 111 is not illustrated.

As illustrated in FIGS. 2 to 6, the development device 2 includes a substantially rectangular developer tank 111 in which a two-component developer containing the toner and the carrier is stored, a toner replenishment port 115*a* through which the toner is replenished into the developer tank 111, a development roller 114 that is provided in the developer tank 111, first and second developer conveyance paths P and Q that are provided between the development roller 114 and a position in which the toner is replenished into the developer tank 111, first and second communication paths "a" and "b" that are provided on both end sides of the first and second developer conveyance paths P and Q to communicate the first and second developer conveyance paths P and Q, first and second developer conveying members 112 and 113 that are rotatably provided in the first and second developer conveyance paths P and Q, a first developer raking member 118A that is disposed in the first communication path "a" to deliver the developer of the first developer conveyance path P into the second developer conveyance path Q, a second developer raking member 118B that is disposed in the second communication path "b" to deliver the developer of the second developer conveyance path Q into the first developer conveyance path P, a doctor blade 116, and a toner density sensor (permeability sensor) 119. In the development device 2, the toner is supplied to the surface of the photoconductive drum 3 by the development roller 114, and the electrostatic latent image formed on the surface of the photoconductive drum 3 is visualized (developed).

The developer tank 111 is partitioned into two chambers by a partition plate 117 that is parallel to a shaft center direction of the development roller 114. In the two chambers, the chamber located on the side of the toner replenishment port 115*a* is the first developer conveyance path P, and the chamber located on the side of the development roller 114 is the second developer conveyance path Q. The first developer conveyance path P and the second developer conveyance path Q are communicated with each other by the first communication path "a" and the second communication path "b", which are located on both the sides in the shaft center direction. Therefore, the first and second developer conveyance paths P and Q and the first and second communication paths a and b constitute one cyclic developer conveyance path.

The developer tank 111 has a detachable developer tank cover 115 that constitutes an upper wall thereof. In the developer tank cover 115, the toner replenishment port 115*a* is formed in order to replenish the unused toner on an upstream side in a developer conveyance direction (direction of arrow X) of the first developer conveyance path P. The developer tank 111 has an opening located between a sidewall on the side of the second developer conveyance path Q and a lower end edge of the developer tank cover 115. The development roller 114 is rotatably disposed in the position of the opening while a predetermined development nip portion N is provided between the development roller 114 and the photoconductive drum 3.

The development roller 114 is a magnet roller that rotates about the shaft center by a driving section (not illustrated). The development roller 114 supports the developer of the developer tank 111 on the surface thereof to supply the toner to the photoconductive drum 3. A development bias voltage is applied to the development roller 114 from a power supply (not illustrated) to supply the toner to the electrostatic latent image on the surface of the photoconductive drum 3 from the developer on the surface of the development roller 114.

The doctor blade 116 is a rectangular plate-like member that is extended in parallel with the shaft line direction of the development roller 114. A lower end 116*b* of the doctor blade 116 is fixed to the lower end edge of the opening of the developer tank 111, and an upper end 116*a* is separated from the surface of the development roller 114 with a predetermined gap. Examples of a material for the doctor blade 116 include stainless steel, aluminum, and synthetic resin.

<<First and Second Developer Conveying Member>>

Figure 7:
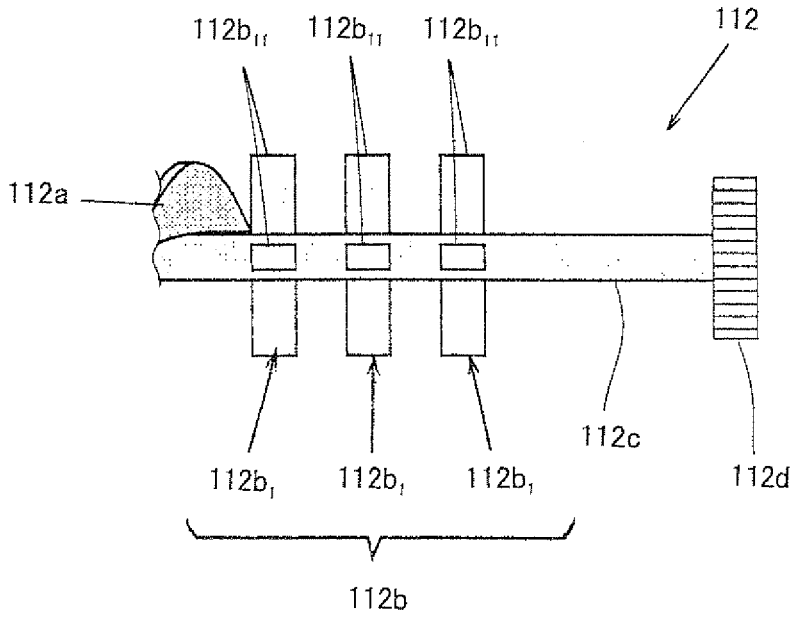
FIG. 7 is an enlarged view illustrating one end part of a first developer conveying member of FIGS. 3 and 4.
Figure 8:
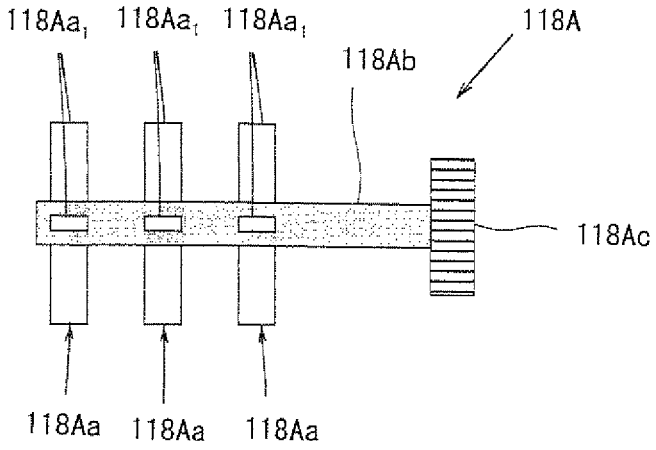
FIG. 8 is an enlarged view illustrating a first developer raking member of FIGS. 3 and 4.

FIG. 7 is an enlarged view illustrating one end part of a first developer conveying member of FIGS. 3 and 4, and FIG. 8 is an enlarged view illustrating a first developer raking member of FIGS. 3 and 4. As illustrated in FIGS. 2 to 7, the first developer conveying member (hereinafter occasionally referred to as "first conveying member") 112 includes a first rotating shaft 112*c* that is rotatably provided in parallel with the first developer conveyance path P, a spiral blade (auger screw) 112*a* that is fixed to an outer circumferential surface of the first rotating shaft 112*c*, a circumferential rotation blade 112*b* that is provided in a downstream end part in the developer conveyance direction (direction of arrow X) in comparison with the spiral blade 112*a* in the first rotating shaft 112*c*, and a first gear 112*d* that is provided in a downstream end part in the developer conveyance direction (direction of arrow X) in comparison with the circumferential rotation blade 112*b* in the first rotating shaft 112*c*. The downstream end part of the first rotating shaft 112*b* pierces one sidewall on a longitudinal direction side of the developer tank 111, the first gear 112*d* is fixed to the end part projected to the outside of the developer tank 111.

The spiral blade 112*a* is provided from a position in which the spiral blade 112*a* is located opposite the second communication path "b" to a position in front of the first communication path "a". On the other hand, the circumferential rotation blade 112*b* includes agitating blade 112$b_1$ having plural projection pieces 112$b_{11}$. The projection pieces 112$b_{11}$ are radially provided at equal center angles on the same circumference of the first rotating shaft 112*c*. The circumferential rotation blade 112*b* is disposed opposite the first communication path "a". In the first embodiment, the one set of agitating blade 112$b_1$ is formed such that the four rectangular projection pieces 112$b_{11}$ are radially provided at the center angle of 90° on the same circumference of the first rotating shaft 112*c*. In the first embodiment, the three sets of agitating blade 112$b_1$ are disposed at equal intervals along the first rotating shaft 112*c*. That is, the circumferential rotation blade 112*b* is formed such that the three sets of agitating blade 112$b_1$ are disposed at equal intervals along the first rotating shaft 112*c*.

The second developer conveying member (hereinafter occasionally referred to as "second conveying member") 113 includes a second rotating shaft 113*c* that is rotatably provided in parallel with the second developer conveyance path Q, a spiral blade (auger screw) 113*a* that is fixed to an outer circumferential surface of the second rotating shaft 113*c*, a circumferential rotation blade 113*b* that is provided in a downstream end part in the developer conveyance direction (direction of arrow Y) in comparison with the spiral blade 113*a* in the second rotating shaft 113*c*, and second gears 113*d* and 113*e* that are provided at both ends of the second rotating shaft 113*c*. The spiral blade 113*a* is provided from a position in which the spiral blade 113*a* is located opposite the first communication path "a" to a position in front of the second communication path "b". The spiral blade 113*a* of the second conveying member 113 is identical to the spiral blade 112*a* of the first conveying member 112 in a spiral winding orientation.

On the other hand, the circumferential rotation blade 113*b* has a configuration similar to that of the circumferential rotation blade 112*b* of the first conveying member 112, and is disposed opposite the second communication path "b". That is, four projection pieces 113$b_{11}$ that compose one set of agitating blade 113$b_1$ are radially provided at the center angle of 90° on the same circumference of the second rotating shaft 113*c*, and the circumferential rotation blade 113*b* is formed such that the three sets of agitating blade 113$b_1$ are disposed at equal intervals along the first rotating shaft 113*c*.

The first gear 112*d* of the first conveying member 112 engages a first driving gear of a driving section (not illustrated, for example, motor), the second gear 113*d* of the second conveying member 113 engages a second driving gear of the driving section, and the first driving gear and the second driving gear relatively reversely rotate, whereby the first gear 112*d* and the second gear 113*d* relatively reversely rotate. Because the spiral blade 112*a* of the first conveying member 112 and the spiral blade 113*a* of the second conveying member 113 relatively reversely rotate, as illustrated in FIG. 3, the developer in the first developer conveyance path P is conveyed in the direction of the arrow X while agitated in the rotation direction, and the developer in the second developer conveyance path Q is conveyed in the direction of the arrow Y while agitated in the rotation direction.

Alternatively, the development device 2 may be configured such that the first and second gears 112*d* and 113*d* engage each other, one of the first and second gears 112*d* and 113*d* engages one driving gear to rotate, and the first conveying member 112 and the second conveying member 113 relatively reversely rotate, whereby the developer is conveyed in the opposite directions in the first developer conveyance path P and the second developer conveyance path Q. Alternatively, the development device 2 may be configured such that the spiral winding orientation of the spiral blade 112*a* of the first conveying member 112 and the spiral winding orientation of the spiral blade 113*a* of the second conveying member 113 are relatively provided in the opposite directions, and the first and second gears 112*d* and 113*d* engage the same driving gear to rotate in the same direction, whereby the developer is conveyed in the opposite directions in the first developer conveyance path P and the second developer conveyance path Q.

<<First and Second Developer Raking Member>>

As illustrated in FIGS. 3 to 8, the first developer raking member (hereinafter occasionally referred to as "first raking member") 118A includes a first short shaft 118Ab, plural sets of first raking blade 118Aa that are disposed at predetermined interval along the first short shaft 118Ab, and a third gear 118Ac that is provided at one end of the first short shaft 118Ab. The first short shaft 118Ab is rotatably provided on the side of the first developer conveyance path P of the first communication path "a" in parallel with the first rotating shaft 112*b*, and the first short shaft 118Ab is located obliquely above the first rotating shaft 112*b*. The first short shaft 118Ab is rotatably supported on one sidewall in the longitudinal direction of the developer tank 111 so as to be disposed obliquely above the first rotating shaft 112*b*, and one end of the first short shaft 118Ab pierces the sidewall of the developer tank 111. In the part in which the first short shaft 118Ab is projected into the developer tank 111, a length of the first short shaft 118Ab is shorter than an opening width of the first communication path "a".

The first raking blade 118Aa includes four projection pieces 118$Aa_1$ that are radially provided at the center angle of 90° on the same circumference of the first short shaft 118Ab, and the first agitating blade 118Aa has the configuration similar to that of the agitating blade 112$b_1$ of the first conveying member 112. In the first embodiment, in the first raking member 118A, the three sets of first raking blade 118Aa are provided at equal intervals along the first short shaft 118Ab.

The third gear 118Ac is fixed to the end of the first short shaft 118Ab projected to the outside of the developer tank 111. For example, the third gear 118Ac engages the first driving gear (not illustrated) that drives the first gear 112*c* of the first conveying member 112, whereby the third gear 118Ac rotates in the same direction as the rotation direction of the first gear 112*c* in synchronization with the first gear 112*c*. More particularly, the first gear 112*c* and the third gear 118Ac are same gears and rotate at the same rotating speed. That is, the first gear 112*c* and the third gear 118Ac constitute a rotation mechanism portion that synchronously rotates the first rotating shaft 112*b* and the first short shaft 118Ab at the same rotating speed.

The second developer raking member (hereinafter occasionally referred to as "second raking member") 118B has the same configuration as the first raking member 118A, and the second raking member 118B includes a second short shaft 118Bb, plural sets of second raking blade 118Ba that are disposed at predetermined interval along the second short shaft 118Bb, and a fourth gear 118Bc that is provided at one end of the second short shaft 118Bb. The second short shaft 118Bb is rotatably supported on the side of the second developer conveyance path Q of the second communication path "b" in parallel with the second rotating shaft 113*b*, and the second short shaft 118Bb is located obliquely above the second rotating shaft 113*b*. The second short shaft 118Bb is rotatably supported on the other sidewall in the longitudinal direction of the developer tank 111 so as to be disposed obliquely above the second rotating shaft 113*b*, and one end of the second short shaft 118Bb pierces the sidewall of the developer tank 111.

The fourth gear 118Bc is fixed to the end of the second short shaft 118Bb projected to the outside of the developer tank 111. For example, the fourth gear 118Bc engages a transmission gear (not illustrated) that engages the second gear 113*e* of the second conveying member 113, whereby the fourth gear 118Bc rotates in the same direction as the rotation direction of the second gear 113*e* in synchronization with the second gear 113*e*. More particularly, the second gear 113*e* and the fourth gear 118Bc are same gears and rotate at the same rotating speed. That is, the second gear 113*e* and the fourth gear 118Bc constitute a rotation mechanism portion that synchronously rotates the second rotating shaft 113*b* and the second short shaft 118Bb at the same rotating speed.

Figure 9:
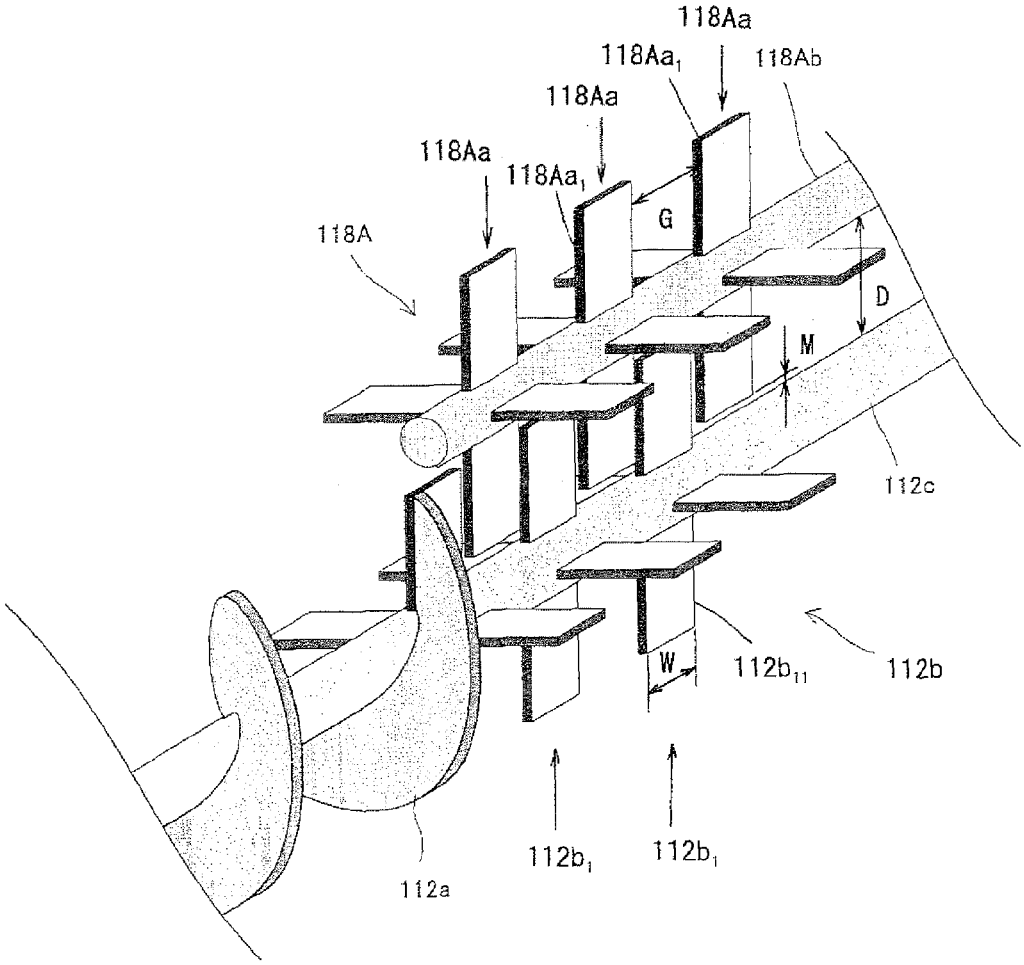
FIG. 9 is a main-part perspective view illustrating a positional relationship between the first developer conveying member and the first developer raking member in the first embodiment.

FIG. 9 is a main-part perspective view illustrating a positional relationship between the first developer conveying member and the first developer raking member in the first embodiment. As illustrated in FIGS. 3 to 6 and 9, the raking blade 118Aa of the first raking member 118A and the agitating blade $\mathbf{112}b_1$ of the first conveying member 112 are alternately arrayed in the shaft direction. In other words, the first raking member 118A and the first conveying member 112 are disposed such that a rotation area A2 of the raking blade 118Aa and a rotation area A1 of the agitating blade $\mathbf{112}b_1$ overlap each other when viewed from the shaft direction, and the one set of agitating blade $\mathbf{112}b_1$ rotates between the projection pieces $\mathbf{118}\mathrm{Aa}_1$ of the two sets of the raking blade 118Aa adjacent to each other in the shaft direction. Therefore, the projection pieces $\mathbf{118}\mathrm{Aa}_1$ and $\mathbf{112}b_{11}$ collide with each other even if the projection pieces $\mathbf{118}\mathrm{Aa}_1$ and $\mathbf{112}b_{11}$ enter the rotation areas A1 and A2 of the agitating blade $\mathbf{112}b_1$ and the raking blade 118Aa when viewed from the shaft direction.

At this point, a ratio W/G of a width W in the shaft direction of the projection piece $\mathbf{112}b_{11}$ of the agitating blade $\mathbf{112}b_1$ to a distance G between the two sets of raking blade 118Aa adjacent to each other in the shaft direction ranges from 0.8 to 0.9. A ratio W/G is set to 0.9 in the first embodiment. When the ratio W/G is set to the range of 0.8 to 0.9, a balance can be achieved between improvement of the transfer efficiency to the raking blade 118Aa of the developer taken up by the agitating blade $\mathbf{112}b_1$ and suppression of the shearing force (stress) applied to the developer. A ratio M/D of a minimum clearance size M between the raking blade 118Aa and the rotating shaft 112*c* to an inter-shaft distance D between the short shaft 118Ab of the first developer raking member 118A and the rotating shaft 112*c* of the first conveying member 112 ranges from 0.5 to 0.95. The ratio M/D is set to 0.9 in the first embodiment. When the ratio M/D is set to the range of 0.5 to 0.9, the balance can be achieved between the improvement of the transfer efficiency of the developer and the suppression of the shearing force (stress) applied to the developer. The ratio W/G and the ratio M/D are similarly set for the second conveying member 113 and the second raking member 118B.

Figure 10:
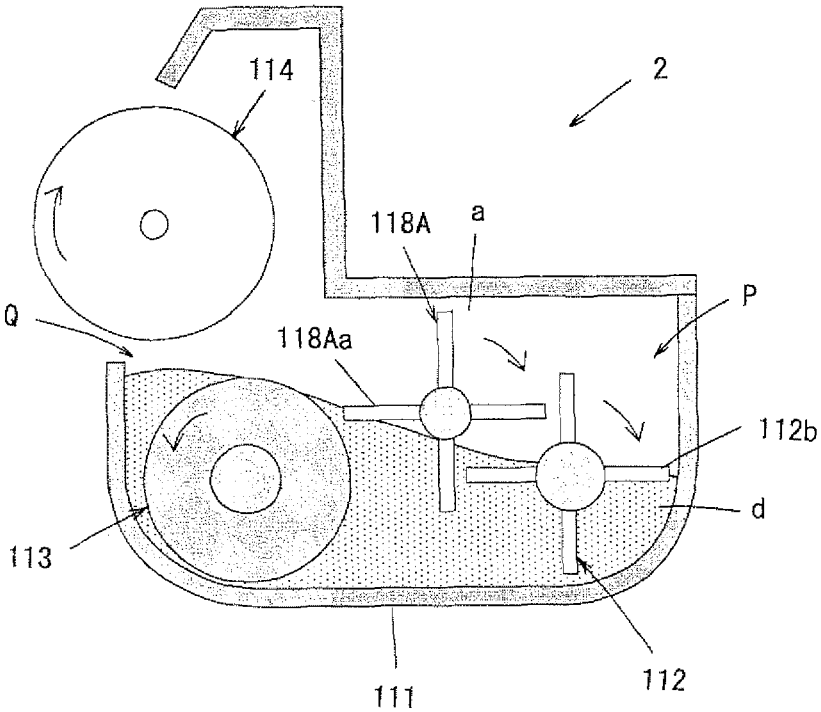
FIG. 10 illustrates a state in which a developer near a first communication path is conveyed in a development device of FIG. 5.

FIG. 10 illustrates a state in which the developer near the first communication path is conveyed in the development device of FIG. 5. As illustrated in FIG. 10, in association with the rotations of the first conveying member 112 and the first raking member 118A, a developer "d" in the first communication path "a" is quickly conveyed from the first conveyance path P toward the second conveyance path Q without retaining the developer "d" in the first communication path "a" (see FIG. 3). Similarly to the case of FIG. 10, in association with the rotations of the second conveying member 113 and the second raking member 118B, the developer in the second communication path "b" is quickly conveyed from the second conveyance path Q toward the first conveyance path P without retaining the developer in the second communication path "b" (see FIGS. 3 and 6).

A toner density detection sensor 119 is mounted on a bottom surface of the developer tank 111 immediately below the second conveying member 113 and a substantially central part of the second developer conveyance path Q, and a sensor surface of the toner density detection sensor 119 is exposed to the inside of the second developer conveyance path Q. The toner density detection sensor 119 is electrically connected to a toner density control section (not illustrated). According to a toner density measured value detected by the toner density detection sensor 119, the toner density control section rotates a toner discharging member 122 of the toner replenishment device 22 to be described later (see FIG. 11) and discharges the toner through a toner discharge port 123 to supply the toner into the first developer conveyance path P of the development device 2.

When the toner density control section determines that the toner density measured value is lower than the toner density setting value, the toner density control section transmits a control signal to a driving section that rotates and drives the toner discharging member 122, and the driving section rotates the toner discharging member 122. For example, general toner density detection sensor such as a transmitted light detection sensor, a reflected light detection sensor, and a permeability detection sensor can be used as the toner density detection sensor 119. Among these, preferably the permeability detection sensor is used as the toner density detection sensor 119.

A power supply (not illustrated) is connected to the permeability detection sensor (toner density detection sensor 119). The power supply applies a driving voltage to the permeability detection sensor to drive the permeability detection sensor, and the power supply also applies a control voltage to the permeability detection sensor to output a detection result of the toner density to the control section. The voltage applied to the permeability detection sensor from the power supply is controlled by the control section. When the control voltage is applied to the permeability detection sensor, the permeability detection sensor outputs the detection result of the toner density as an output voltage value. Because basically the permeability detection sensor has good sensitivity near a median value of the output voltage, the control voltage is applied to the permeability detection sensor such that the output voltage near the median value is obtained. This kind of permeability detection sensor is commercially available. For example, product names TS-L, TS-A, and TS-K (TDK Corporation) can be cited as the permeability detection sensor.

(Toner Replenishment Device)

Figure 11:
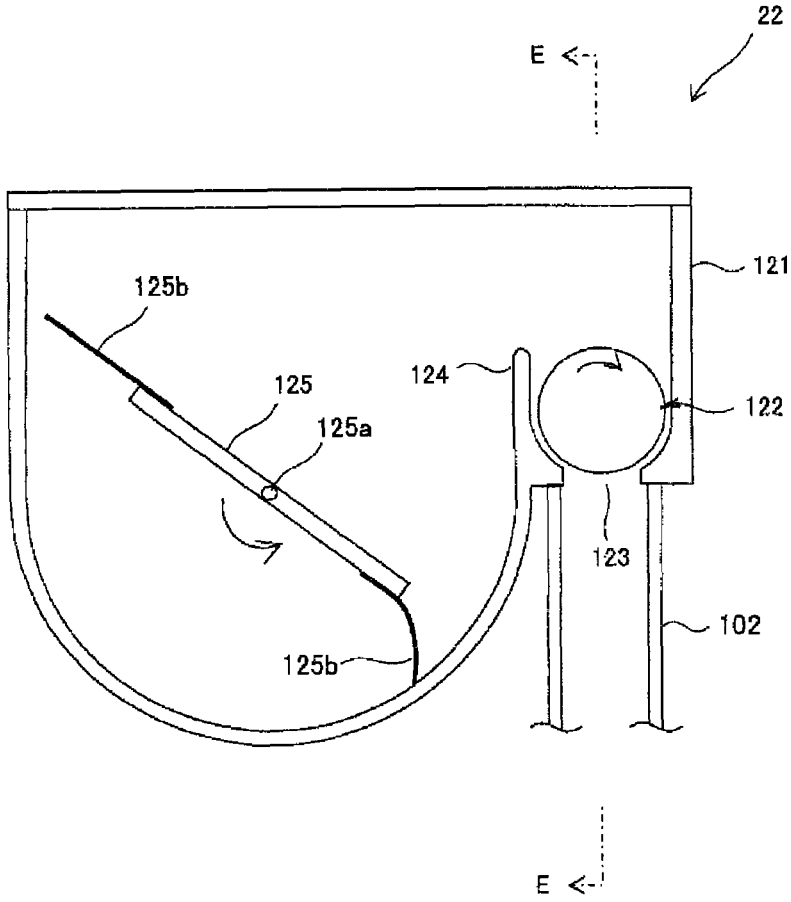
FIG. 11 is a schematic sectional view illustrating a toner replenishment device in the development device of the first embodiment.
Figure 12:
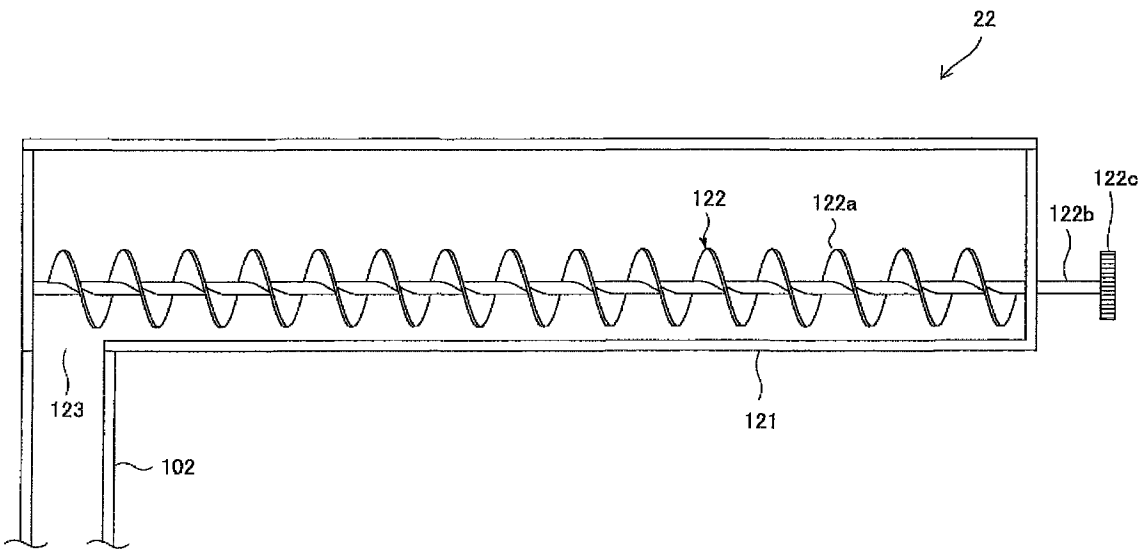
FIG. 12 is a sectional view taken on a line E-E of FIG. 11.

FIG. 11 is a schematic sectional view illustrating the toner replenishment device in the development device of the first embodiment, and FIG. 12 is a sectional view taken on a line E-E of FIG. 11. As illustrated in FIGS. 11 and 12, the toner replenishment device 22 includes a toner storage container 121 having the toner discharge port 123, a toner agitating member 125, and a toner discharging member 122. The unused toner is stored in the toner replenishment device 22. The toner replenishment device 22 is disposed above the developer tank 111 (see FIG. 1), and the toner discharge port 123 and the toner replenishment port 115*a* (see FIG. 2) of the development device 2 are connected by a toner conveyance pipe 102.

The toner storage container 121 is a substantially semi-cylindrical container member having an internal space, and the toner discharge port 123 is disposed at a lateral position in a circumferential direction of the semi-cylindrical part. The toner agitating member 125 is rotatably disposed at the substantially central position in the semi-cylindrical part of the toner storage container 121, and the toner discharging member 122 is rotatably disposed above and near the toner discharge port 123.

The toner agitating member 125 is a plate-like member that rotates about a rotating shaft 125*a*, and the toner agitating member 125 includes sheet-like toner scooping-up members 125*b* made of flexible resin (for example, polyethylene terephthalate) at both leading ends separated from the rotating shaft 125*a*. The rotating shaft 125*a* is rotatably supported on sidewalls on both sides in the longitudinal direction of the toner storage container 121, and one end of the rotating shaft 125*a* pierces the sidewall and is connected to a gear that engages a driving gear of a driving section (not illustrated).

The toner scooping-up member 125*b* rotates from below to upward with respect to the toner discharge port 123, whereby the toner agitating member 125 scoops up the toner stored in the toner storage container 121 to convey the toner to the toner discharging member 122 while agitating the toner. At this point, because of flexibility, the toner scooping-up member 125*b* rotates while being deformed by sliding along the inside wall of the toner storage container 121, and the toner scooping-up member 125*b* supplies the toner onto the side of the toner discharging member 122. A toner discharging member division wall 124 is provided between the toner discharging member 122 and the toner agitating member 125 such that the toner scooped up by the toner agitating member 125 can be retained a proper amount of toner around the toner discharging member 122.

The toner discharging member 122 includes a rotating shaft 122*b* whose both ends are rotatably supported on sidewalls on both sides in the longitudinal direction of the toner storage container 121, a spiral blade 122*a* that is fixed to an outer circumferential surface of the rotating shaft 122*b*, and a gear 122*c* that is fixed to one end of the rotating shaft 122*b*. The end of the rotating shaft 122*b* pierces the sidewall of the toner storage container 121. The gear 122*c* engages a driving gear of a driving section (not illustrated). The toner discharge port 123 is disposed on the downstream side in the direction in which the toner is conveyed by the toner discharging member 122. The toner is conveyed toward the side of the toner discharge port 123 by the spiral blade 122 by the rotation of the toner discharging member 122, and the toner is supplied from the toner discharge port 123 into the developer tank 111 through the toner conveyance pipe 102.

<<Actuation of Development Device>>

Actuation of the development device 2 will be described below with reference to FIGS. 1 to 6. In a development process of the image forming apparatus, as illustrated in FIGS. 5 and 6, the development roller 114, the first and second conveying members 112 and 113, and the first and second raking members 118A and 118B of the development device 2 rotate in an arrow direction. At this point, the developer in the first developer conveyance path P is conveyed in the direction of the arrow X (see FIGS. 3 and 4) by the first conveying member 112 while agitated in the circumferential direction of the rotation, and the toner is delivered to the downstream agitating blade 112*b*. The developer in the second developer conveyance path Q is conveyed in the direction of the arrow Y (see FIG. 3) by the second conveying member 113 while agitated in the circumferential direction of the rotation, and the toner is delivered to the downstream agitating blade 113*b*. At the same time, the downstream developer in the first developer conveyance path P is transferred from the agitating blade 112*b* to the raking blade 118Aa of the first raking member 118A. Therefore, the toner is raked in the direction at right angle to the direction of the arrow X and smoothly delivered to the second developer conveyance path Q. The downstream developer in the second developer conveyance path Q is transferred from the agitating blade 113*b* to the raking blade 118Ba of the second raking member 118B. Therefore, the toner is raked in the direction at right angle to the direction of the arrow Y and smoothly delivered to the first developer conveyance path P. As described above, the developer in the developer tank 111 is cycled between the first developer conveyance path P and the second developer conveyance path Q, and the toner of the developer is sufficiently charged by the friction between the toner and the carrier.

Part of the developer moved in the second developer conveyance path Q is supplied to the development roller 114. The developer supplied to the development roller 114 is delivered to the photoconductive drum 3 (see FIG. 2) while becoming a developer layer having an even thickness in the outer circumferential surface of the development roller 114 by the doctor blade 116, and the toner is partially supplied from the developer layer to the photoconductive drum 3. Then the developer whose toner density is degraded is mixed with the developer in the second developer conveyance path Q from the development roller 114. Accordingly, the toner density is gradually degraded in the developer of the second developer conveyance path Q.

Because the toner density of the developer in the second developer conveyance path Q is detected by the toner density sensor 119, when the toner density becomes a predetermined value or less, the toner replenishment device 22 replenishes the unused toner onto the developer (internal developer) in the first developer conveyance path P, and the replenishment toner is mixed and dispersed in the internal developer by the rotation of the first conveying member 112.

(Intermediate Transfer Belt Unit and Intermediate Transfer Belt Cleaning Unit)

As illustrated in FIG. 1, the intermediate transfer belt unit 8 disposed above the photoconductive drum 3 includes an intermediate transfer belt 7, intermediate transfer roller 6*a*, 6*b*, 6*c*, and 6*d* (hereinafter, the numerals are unified by the numeral 6) that tension the intermediate transfer belt 7 thereabout to rotate the intermediate transfer belt 7 in the direction of arrow B of FIG. 1, a driving roller 71, a driven roller 72 and a belt tension mechanism (not illustrated), and a transfer roller 11 that is disposed beside the driving roller 71 while brought close to the driving roller 71. The intermediate transfer rollers 6 are supported on roller mounting portions in the belt tension mechanism. Additionally, an intermediate transfer belt cleaning unit 9 is disposed on the side of the driven roller 72 of the intermediate transfer belt unit 8.

The driving roller 71 and the driven roller 72 are disposed outside the photoconductive drums 3 located on both ends of the four photoconductive drums 3 such that the intermediate transfer belt 7 comes into contact with the photoconductive drums 3. The intermediate transfer belt 7 is formed in an endless manner using a film having a thickness of about 100 to about 150 μm. The toner images of the color components formed on the photoconductive drum 3 are sequentially transferred to and superposed on the outside surface of the intermediate transfer belt 7, thereby forming the color toner image (multi-color toner image).

The toner image is transferred from the photoconductive drum 3 to the intermediate transfer belt 7 by the intermediate transfer rollers 6 that are in contact with an inside surface of the intermediate transfer belt 7. The intermediate transfer roller 6 includes a metallic shaft (for example, stainless steel) having a diameter of 8 to 10 mm and a conductive elastic material layer. The outer circumferential surface of the metallic shaft is covered with the conductive elastic material layer. Examples of the material for the conductive elastic material layer include ethylene-propylene-diene ternary copolymer (EPDM) including a conductive agent such as carbon black and urethane foam. A high-voltage transfer bias (high voltage of a polarity (+) opposite toner charging polarity (−)) is applied to the metallic shaft of the intermediate transfer roller 6 in order to transfer the toner image, which allows the intermediate transfer roller 6 to evenly apply the high voltage to the intermediate transfer belt 7. In the first embodiment, the intermediate transfer roller 6 is used as the transfer electrode. In addition, for example, a brush may be used.

The toner images laminated on the outside surface of the intermediate transfer belt 7 is moved to the position (transfer portion) of the transfer roller 11 by the rotation of the intermediate transfer belt 7. On the other hand, the recording medium is also conveyed to the transfer portion through the sheet conveyance path S, and the transfer roller 11 presses the recording medium against the intermediate transfer belt 7, thereby transferring the toner images on the intermediate transfer belt 7 to the recording medium. At this point, the intermediate transfer belt 7 and the transfer roller 11 are pressed against each other at a predetermined nip, and the high voltage for transferring the toner image onto the recording medium having a polarity (+) opposite the toner charging polarity (−) is applied to the transfer roller 11. One of the transfer roller 11 and the driving roller 71 is made of a hard material such as metal while the other is made of a soft material such as rubber and a foaming resin such that the nip between the intermediate transfer belt 7 and the transfer roller 11 is steadily obtained.

The toner that is not transferred from the intermediate transfer belt 7 to the recording medium but left on the intermediate transfer belt 7 causes color mixture of the toner when the new toner image is laminated on the intermediate transfer belt 7. Therefore, the residual toner is removed and recovered by the intermediate transfer belt cleaning unit 9. The intermediate transfer belt cleaning unit 9 includes a cleaning blade that comes into contact with the intermediate transfer belt 7 to remove the residual toner and a toner recovery portion that recovers the removed toner. A part that is in contact with the cleaning blade in the intermediate transfer belt 7 is supported by the driven roller 72.

(Sheet Conveyance Path and Peripheral Members Thereof)

As illustrated in FIG. 1, the sheet conveyance path S is communicated with the sheet discharge tray 15 from the paper feeding tray 10 and the manual paper feeding tray 20 through the fixing device 12 to be described later. Pickup rollers 16*a* and 16*b*, conveyance rollers 25*a* to 25*f* (hereinafter, the numerals are unified by the numeral 25), a registration roller 14, a transfer roller 11, and a fixing device 12 are disposed around the sheet conveyance path S. The conveyance roller 25 is a small-size roller in order to promote and assist the sheet conveyance, and plural pairs of conveyance rollers 25 are provided along the sheet conveyance path S. The pickup roller 16*a* is provided in the end part of the paper feeding tray 10, and the pickup roller 16*a* is an attraction roller that supplies the sheet-like recording medium (recording sheet) one by one from the paper feeding tray 10 to the sheet conveyance path S. The pickup roller 16*b* is provided near the manual paper feeding tray 20, and the pickup roller 16*b* is an attraction roller that supplies the recording medium one by one from the manual paper feeding tray 20 to the sheet conveyance path S. The registration roller 14 tentatively retains the recording medium conveyed through the sheet conveyance path 5, and the registration roller 14 conveys the recording medium to the transfer portion at the time the leading end of the toner image on the intermediate transfer belt 7 is aligned with the leading end of the recording medium.

[Fixing Device Accommodation Portion]

As illustrated in FIG. 1, the fixing device 12 accommodated in the fixing device accommodation portion 100B includes a heat roller 81 and a pressure roller 82, which rotate mutually reversely while the recording medium to which the toner image is transferred is interposed therebetween, a conveyance roller 25*b*, and a sheet discharge roller 25*c*. The heat roller 81 is controlled by a controller (not illustrated) so as to become a predetermined fixing temperature. The controller controls the temperature at the heat roller 81 based on a detection signal from a temperature detector (not illustrated). The heat roller 81 that is raised to the fixing temperature and the pressure roller 82 are pressed against the recording medium to melt the toner, thereby fixing the toner image on the recording medium. The recording medium to which the toner image is fixed is conveyed to an inversion sheet discharge path of the sheet conveyance path S by the conveyance roller 25*b* and the sheet discharge roller 25*c*, and the recording medium is discharged onto the sheet discharge tray 15 while inverted (in the state in which the toner image is oriented downward).

Another Embodiment

In the circumferential rotation blade 112*b* of the first conveying member 112 and the raking blade 118Aa of the first raking member 118A in the first embodiment, the projection pieces 112$b_{11}$ and 118$Aa_1$ are arrayed while the positions of the projection pieces 112$b_{11}$ and 118$Aa_1$ are alternately shifted in the shaft direction such that the projection pieces 112$b_{11}$ and 118$Aa_1$ do not come into contact with each other (see FIG. 9). The circumferential rotation blade 112*b* and the raking blade 118Aa are not limited to the configuration of the first embodiment. For example, the three projection pieces 112$b_{11}$ arrayed in the shaft direction of the circumferential rotation blade 112*b* and the three projection pieces 118$Aa_1$ arrayed in the shaft direction of the raking blade 118Aa may be changed to one continuously-integrated projection piece, respectively. In such cases, the circumferential rotation blade 112*b* and the raking blade 118Aa rotate in the timing in which the projection pieces of the circumferential rotation blade 112*b* and the raking blade 118Aa do not come into contact with each other. For example, the circumferential rotation blade 112*b* of FIG. 5 rotates reversely. The same holds true for the circumferential rotation blade 113*b* and the raking blade 118Ba in the second conveying member 113 and the second raking member 118B.

What is claimed is:

1. A development device that is mounted on an electrophotographic image forming apparatus including a photoconductive drum of which an electrostatic latent image is formed on a surface, the development device comprising:

a developer tank in which a developer containing a toner and a carrier are stored;

a toner replenishment port through which the toner is replenished into the developer tank;

a development roller that rotates to supply the toner to the surface of the photoconductive drum on which the electrostatic latent image is formed while bearing the developer of the developer tank;

a developer conveyance path that includes first and second developer conveyance paths and first and second communication paths, the first developer conveyance path being disposed on a side of the toner replenishment port, the second developer conveyance path being disposed on a side of the development roller, first and second developer conveyance paths being partitioned by a partition plate parallel to a shaft direction of the development roller, the first and second communication paths communicating the first and second developer conveyance paths on both sides in the shaft center direction;

first and second developer conveying members that are disposed in the first and second developer conveyance paths; and a developer raking member that is rotatably disposed in at least one of the first and second communication paths, wherein the first and second developer conveying members comprise:

a rotating shaft;

a spiral blade that is mounted in an outer circumferential surface of the rotating shaft; and a circumferential rotation blade that is mounted on one end on a downstream side in a developer conveyance direction of the rotating shaft;

the spiral blades of the first and second developer conveying members rotate to mutually convey the developer in opposite directions, the developer is agitated about a shaft center on the conveyance direction downstream side by the circumferential rotation blades of the first and second developer conveying members, and the developer raking member rotates to convey the developer in one of the developer conveyance paths to the other of the developer conveyance path while being not in contact with the circumferential rotation blade, thereby cycling the developer between the first developer conveyance path and the second developer conveyance path;

wherein the developer raking member includes a short shaft that is rotatably provided in parallel with the rotating shaft and a raking blade having plural projection pieces that are radially provided on an identical circumference of the short shaft at equal center angles;

wherein the circumferential rotation blade includes an agitating blade having plural projection pieces that are radially provided on an identical circumference of the rotating shaft at equal center angles; and wherein plural sets of the raking blade are disposed at predetermined intervals along the short shaft, plural sets of the agitating blade are disposed at predetermined intervals along the rotating shaft, and the plural sets of the raking blade and the plural sets of the agitating blade are located so as to be alternately arrayed in a shaft direction.

2. A development device according to claim 1, wherein the developer raking members are provided in both the first and second communication paths.

3. A development device according to claim 1, wherein a ratio W/G of a width W in the shaft direction of the projection piece of the agitating blade to a distance G between the two sets of the raking blade adjacent to each other ranges from 0.8 to 0.9.

4. A development device according to claim 1, wherein a ratio M/D of a minimum clearance size M between the raking blade and the rotating shaft to a inter-shaft distance D between the short shaft of the developer raking member and the rotating shaft of the developer conveying member ranges from 0.5 to 0.95.

5. A development device according to claim 1, wherein in the developer raking member, the short shaft is disposed higher than the rotating shaft, and the projection pieces of the raking blade rotates from above toward the agitating blade.

6. A development device according to claim 5, wherein the projection pieces of the agitating blade rotates from below toward the raking blade.

7. An image forming apparatus comprising:

a photoconductive drum that forms an electrostatic latent image on a surface thereof;

a charging device that charges the surface of the photoconductive drum;

an exposure device that forms an electrostatic latent image on the surface of the photoconductive drum;

the development device according to claim 1 that supplies the toner to the electrostatic latent image on the surface of the photoconductive drum to form an toner image;

a toner replenishment device that replenish the toner to the development device; a transfer device that transfers the toner image on the surface of the photoconductive drum to a recording medium; and a fixing device that fixes the toner image onto the recording medium.

* * * * *